US008956014B2

(12) United States Patent
Jurik et al.

(10) Patent No.: US 8,956,014 B2
(45) Date of Patent: Feb. 17, 2015

(54) ANIMATION WHEEL FOR AN AUTOMATED LUMINAIRE

(75) Inventors: Pavel Jurik, Postredni Becva (CZ); Josef Valchar, Postredni Becva (CZ)

(73) Assignee: Robe Lighting SRO

( * ) Notice: Subject to any disclaimer, the term of this patent is extended or adjusted under 35 U.S.C. 154(b) by 60 days.

(21) Appl. No.: 13/052,083

(22) Filed: Mar. 20, 2011

(65) Prior Publication Data

US 2011/0249442 A1 Oct. 13, 2011

Related U.S. Application Data

(60) Provisional application No. 61/316,322, filed on Mar. 22, 2010.

(51) Int. Cl.

| | |
|---|---|
| ***F21S 8/00*** | (2006.01) |
| ***F21S 10/00*** | (2006.01) |
| *F21W 131/406* | (2006.01) |

(52) U.S. Cl.

CPC ..... *F21S 10/007* (2013.01); *F21W 2131/406* (2013.01)

USPC ..... 362/277; 362/235

(58) Field of Classification Search

USPC ..... 362/235, 277

See application file for complete search history.

(56) References Cited

U.S. PATENT DOCUMENTS

| | | | | |
|---|---|---|---|---|
| 6,474,837 | B1 * | 11/2002 | Belliveau | 362/231 |
| 7,543,941 | B2 * | 6/2009 | Holder et al. | 353/43 |
| 8,262,252 | B2 * | 9/2012 | Bergman et al. | 362/237 |
| 2001/0043313 | A1 * | 11/2001 | Okura | 353/97 |

* cited by examiner

*Primary Examiner* — Anabel Ton

(57) ABSTRACT

Described is an animation wheel for an automated luminaire for quick and direct movement between different individual gobos or for positioning anywhere through a plate which substantially exceed the size of the light beam cross-section.

10 Claims, 8 Drawing Sheets

ANIMATION WHEEL FOR AN AUTOMATED LUMINAIRE

RELATED APPLICATION

This application is a utility filing claiming priority of provisional application 61/316,322 filed on 22 Mar. 2010.

TECHNICAL FIELD OF THE INVENTION

The invention relates to equipment for the selection and movement of images or gobos within an automated luminaire.

BACKGROUND OF THE INVENTION

Luminaires with automated and remotely controllable functionality are well known in the entertainment and architectural lighting markets. Such products are commonly used in theatres, television studios, concerts, theme parks, night clubs and other venues. A typical product will commonly provide control over the pan and tilt functions of the luminaire allowing the operator to control the direction the luminaire is pointing and thus the position of the light beam on the stage or in the studio. Typically this position control is done via control of the luminaire's position in two orthogonal rotational axes usually referred to as pan and tilt. Many products provide control over other parameters such as the intensity, color, focus, beam size, beam shape and beam pattern. The beam pattern is often provided by a stencil or slide called a gobo which may be a steel, aluminum or etched glass pattern. The products manufactured by Robe Show Lighting such as the ColorSpot 700E are typical of the art.

Such gobos are typically the size of the luminaire's optical aperture and systems may be provided to select between different gobos, often mounted on a wheel, or to rotate a gobo once selected. The optical systems of such luminaires may further include gobos, patterns or other optical effects which are larger than the optical aperture and may allow movement across or through the beam to produce effects such as rainfall or fire. Such devices are often termed animation wheels and may be included in addition to gobos so as to further modify the light beam.

FIG. 1 illustrates a multiparameter automated luminaire system 10. These systems commonly include a plurality of multiparameter automated luminaires 12 which typically each contain on-board a light source (not shown), light modulation devices, electric motors coupled to mechanical drives systems and control electronics (not shown). In addition to being connected to mains power either directly or through a power distribution system (not shown), each luminaire is connected is series or in parallel to data link 14 to one or more control desks 15. The luminaire system 10 is typically controlled by an operator through the control desk 15.

FIG. 2 illustrates a prior art automated luminaire 12. A lamp 21 contains a light source 22 which emits light. The light is reflected and controlled by reflector 20 through an aperture or imaging gate 24 and through an animation wheel 25. The resultant light beam may be further constrained, shaped, colored and filtered by optical devices 26 which may include dichroic color filters, gobos, rotating gobos, framing shutters, effects glass and other optical devices well known in the art. The final output beam may be transmitted through output lenses 28 and 29 which may form a zoom lens system.

FIG. 3 illustrates a prior art gobo wheel 1 containing five gobos 3 and an open aperture. The wheel 1 may be rotated 5 such that any of the gobos 3 may be positioned across the optical aperture of the luminaire 4.

FIG. 4 illustrates a further prior art gobo wheel 6. In this version the gobos 8 are contained within carriers 2 that may be rotated through gears 8. The wheel may be rotated such that any of the gobo carriers 2 containing a gobo 8 are positioned across the optical aperture of the luminaire 7 and said selected gobo carrier 2 may then be rotated around the optical axis of the luminaire producing a dynamic effect in the output beam.

In both examples to change gobos from a first gobo to a second, non-adjacent, gobo requires that the wheel be rotated through all the gobos in between the first and second gobos. It would be advantageous if a gobo system could change from a first gobo to any second gobo without having to pass through intermediate gobos.

In addition it would be advantageous if gobos larger than the optical aperture could be inserted and removed from the optical aperture in any position or orientation.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the FIGUREs, like numerals being used to refer to like and corresponding parts of the various drawings.

The present invention generally relates to an automated luminaire, specifically to the configuration of an animation wheel within such a luminaire such that selection may be made between any two gobos, adjacent or non-adjacent, without the need to pass through intermediate gobos and such that gobos larger than the optical aperture may be utilized.

Figure 1:
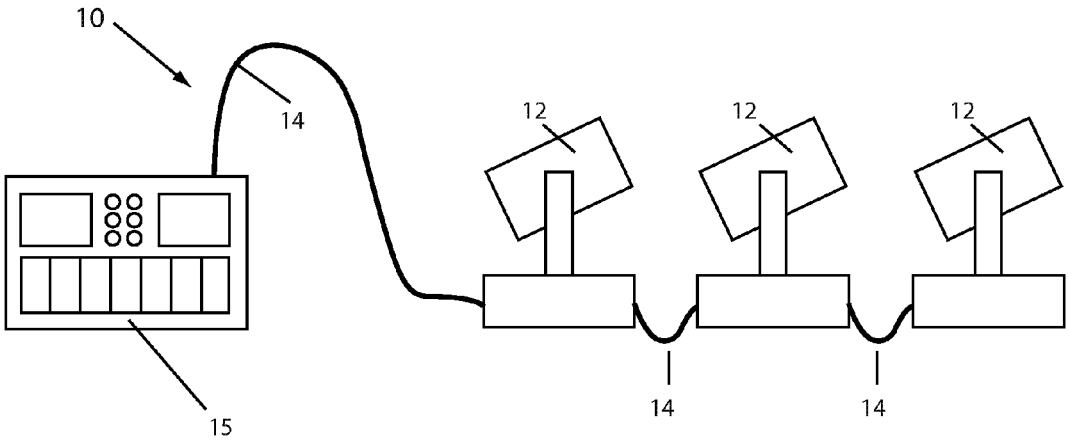
FIG. 1 illustrates a typical automated lighting system.
Figure 2:
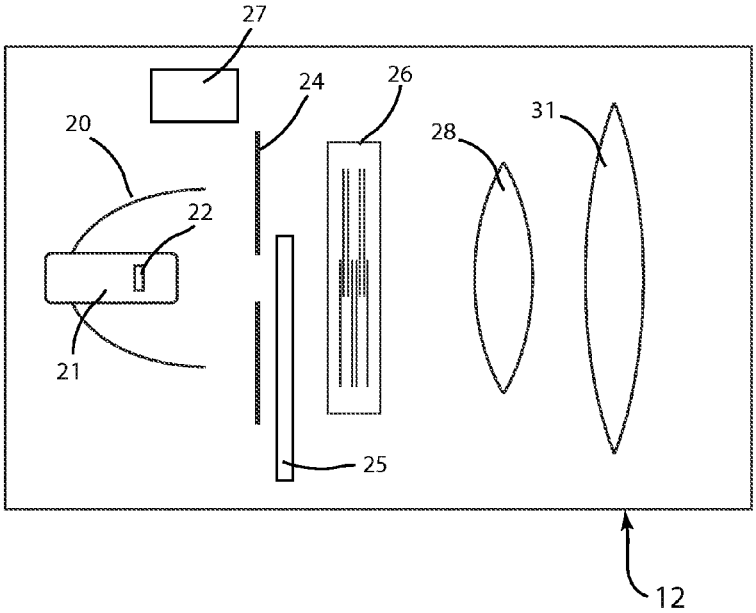
FIG. 2 illustrates a typical automated luminaire.
Figure 3:
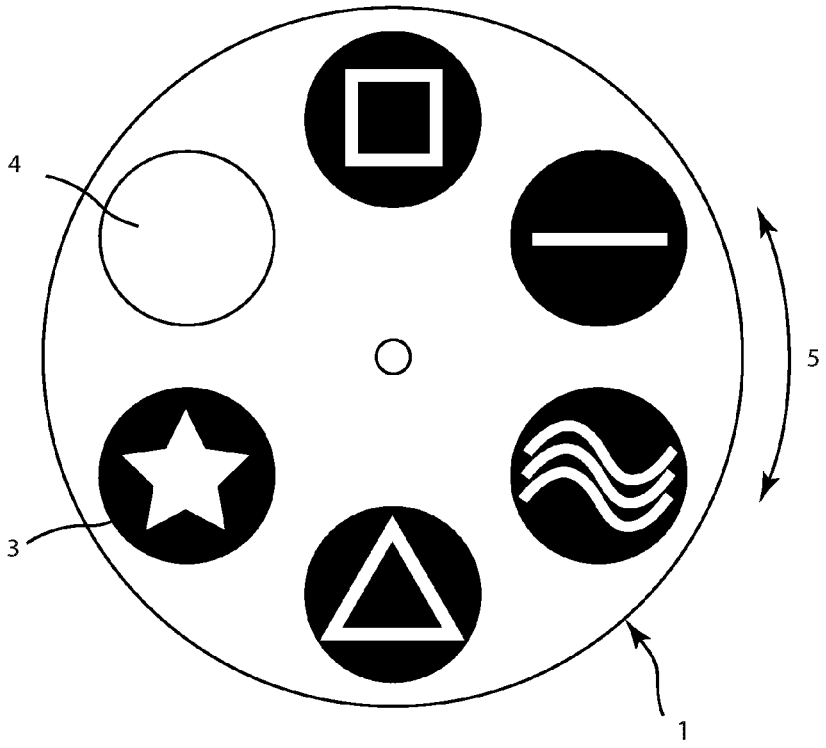
FIG. 3 illustrates a prior art gobo wheel.
Figure 4:
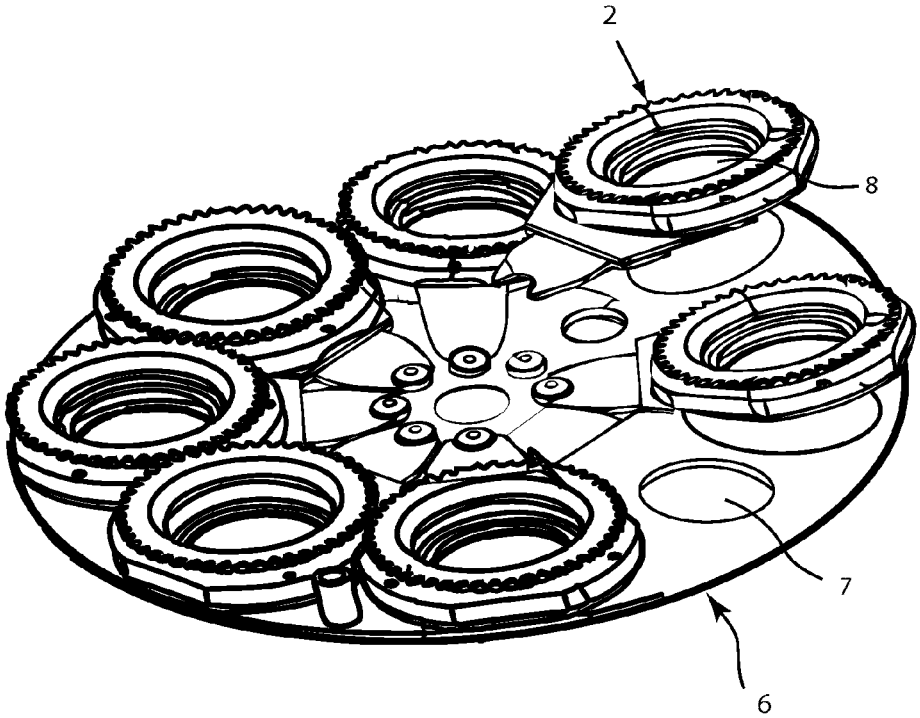
FIG. 4 illustrates a prior art rotating gobo wheel.
Figure 5:
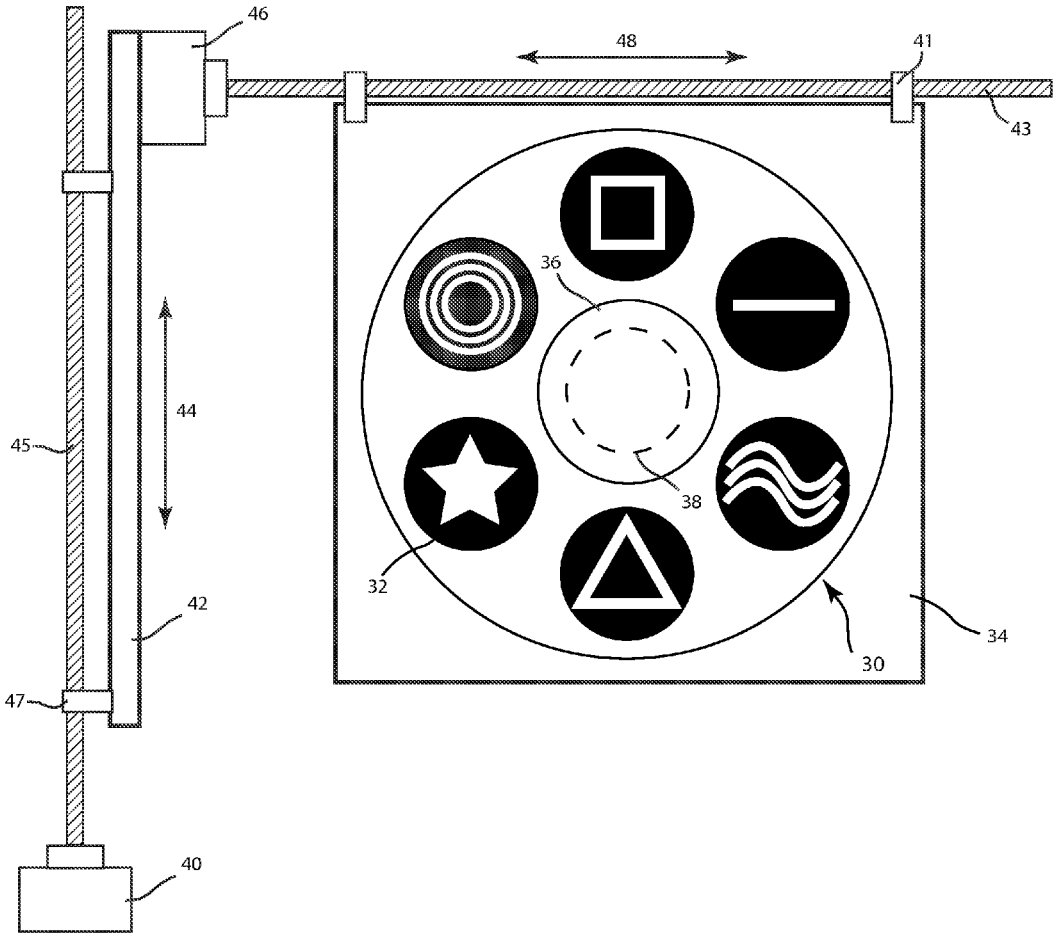
FIG. 5 illustrates an embodiment of an animation wheel.

FIG. 5 illustrates a schematic drawing of an embodiment of the invention. Carrier plate 34 contains a gobo wheel 30 which, in turn, carries gobos 32. Such gobos 32 may be separate gobos individually and separately replaceable on gobo wheel 30 or may be an integral part of wheel 30. In the embodiment illustrated, gobo wheel 30 has a central aperture 36 which is the same size or larger than the size of a cross section of the light beam 38 at the location of the animation plate 34 along the luminaire's optical axis. In its normal, resting position as shown in FIG. 5 gobo wheel aperture 36 is coaxial with cross-section of the light beam 38.

Carrier plate 34 is connected to mounts 41 that include a threaded hole threaded onto threaded rod 43 that may be rotated by motor 46 forming a screw drive. Rotation of motor 46 produces rotation of threaded rod 46. Since rotation of the mounts 41 is prevented, rotation of the threaded rod 46 results in linear movement 48 of mounts 41 and thus carrier plate 34. Motor 46 may be rotated in either direction to give complete and accurate control of the position of carrier plate 34 in one plane of motion.

Similarly the assembly of motor 46, rod 48, mounts 41 and carrier plate 34 is itself mounted to bar 42. Bar 42 is, in turn, connected to mounts 47 that include a threaded hole threaded onto threaded rod 45 that may be rotated by motor 40 forming a screw drive. Rotation of motor 40 produces rotation of threaded rod 45. Since rotation of the mounts 47 are prevented, rotation of the threaded rod 48 results in linear movement 44 of mounts 47 and bar 42 with its connected assembly and thus the carrier plate 34. Motor 40 may be rotated in either direction to give complete and accurate control of the position of carrier plate 34 in a plane of motion orthogonal to that provided by motor 46. Motors 40 and 46 may be of a type selected from a list comprising but not limited to, stepper motors, servo motors, and linear actuators.

Through this mechanism by coordinated and separate adjustment of motors 40 and 46 carrier plate 34 and attached gobo wheel 30 may be positioned such that any of the gobos 32 are positioned across the optical aperture 38. It can further be seen that as the movement of carrier plate 34 and attached gobo wheel 30 may be in any direction desired it is possible to move directly from a first position where wheel aperture 36 is coaxial with optical aperture 38 to a second position where any of the gobos 32 are across the optical aperture 38 without the need to pass through any other gobos 32.

Further, to move from a first gobo 32 to a second gobo 32 the operator may choose to either move directly to the second gobo without concern for intervening gobos or may choose to first return to the open wheel aperture 36 before continuing to select a second gobo 32. Thus the operator has complete control over the route taken from a first gobo to a second gobo.

The specific mechanism illustrated herein using two threaded rods and threaded mounts is illustrative only and not a limitation of the invention. Other mechanisms well known in the art to move carrier plate 34 in two orthogonal directions may be used without departing from the spirit of the invention. In alternative embodiments the orientation of the drives may not be orthogonal. What is important is that the drives provides two degrees of freedom of motion to position the carrier plate anywhere within the confines of a constrained two-dimensional plane.

Figure 6:
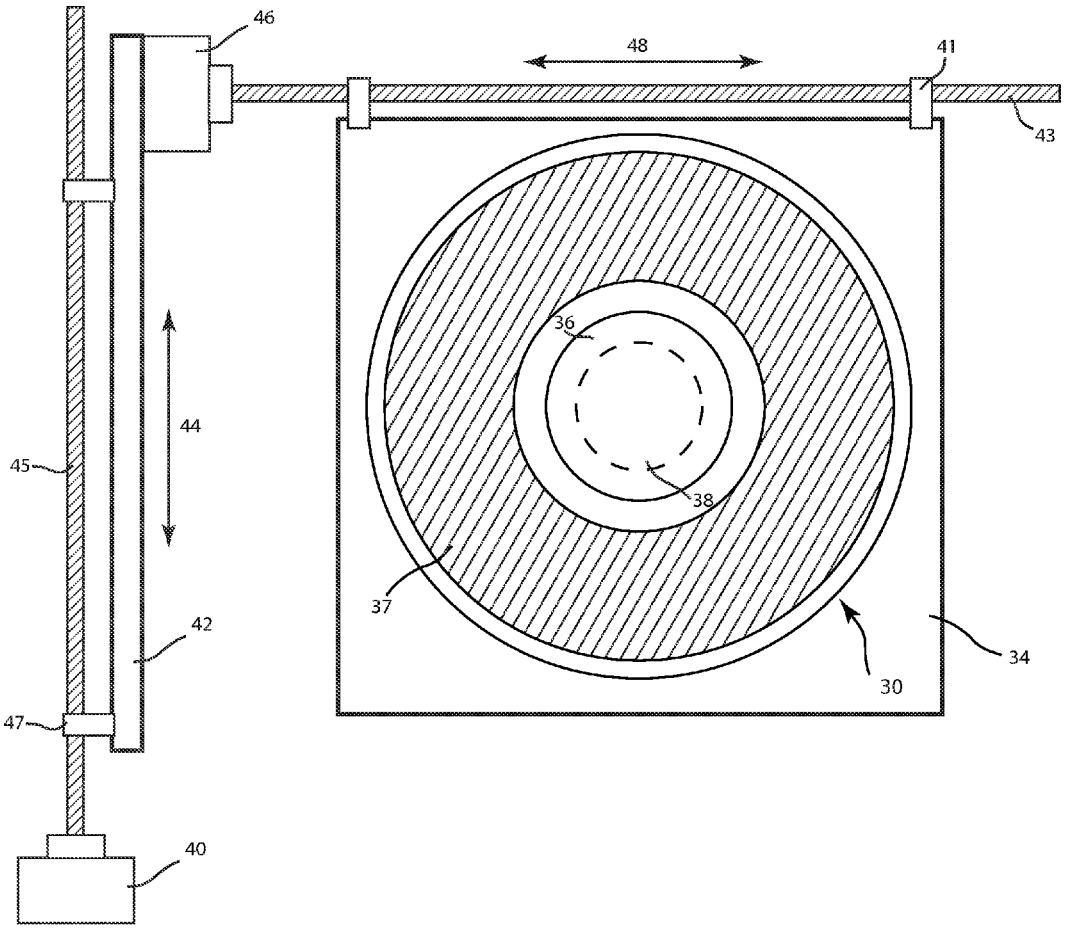
FIG. 6 illustrates an alternative embodiment of an animation wheel.

FIG. 6 illustrates a schematic drawing of an embodiment of the invention. In this embodiment the movement of carrier plate 34 in two orthogonal directions is as described for FIG. 5. However instead of repositioning a gobo wheel with individual discrete gobos 32 gobo wheel 30 contains a single large gobo, pattern or effect 37. Through this mechanism by coordinated and separate adjustment of motors 40 and 46 carrier plate 34 and attached gobo wheel 30 may be positioned such that any portion of the gobo 37 may be positioned across the optical aperture 38. Gobo 37 may comprise a single large pattern or optical effect or may contain multiple individual images.

A further advantage of the invention is the speed with which any gobo or a portion of a gobo may be selected. As selection can always move directly from a first current position to a second target position no movement is wasted and minimum length moves, and thus minimum time moves, are possible.

Figure 7B:
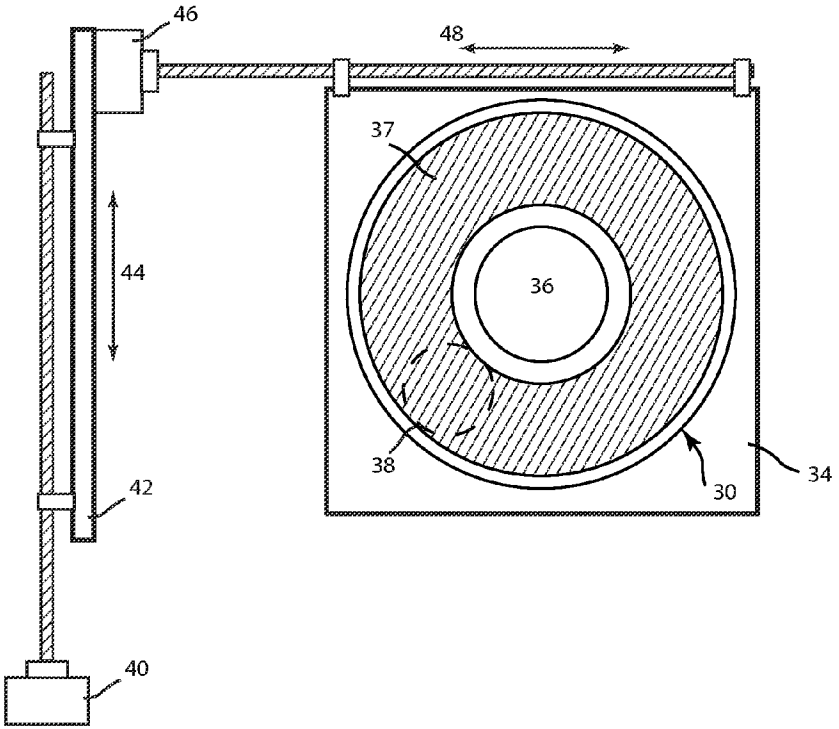
FIG. 7 illustrates positions of the embodiment of FIG. 6.
Figure 7A:
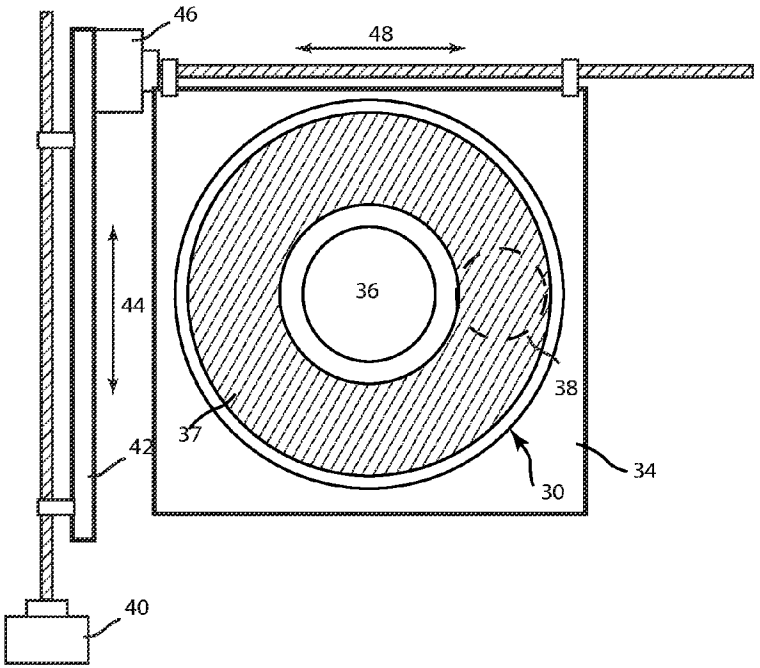

FIGS. 7*a* and 7*b* further illustrate an embodiment of the invention and show two possible positions for the mechanism. In FIG. 7*a* motor 46 has positioned carrier plate 34 as far to the left as possible while motor 40 has positioned carrier plate in a mid position vertically. This results in the central right portion of gobo 37 being positioned across optical aperture 38. FIG. 7*b* illustrates a second position where both motors 40 and 46 have repositioned carrier plate 34 such that a lower left portion of gobo 37 is positioned across optical aperture 38. It is clear that through manipulation of motors 40 and 46 any portion of gobo 37 may be positioned across optical aperture 38.

Figure 8:
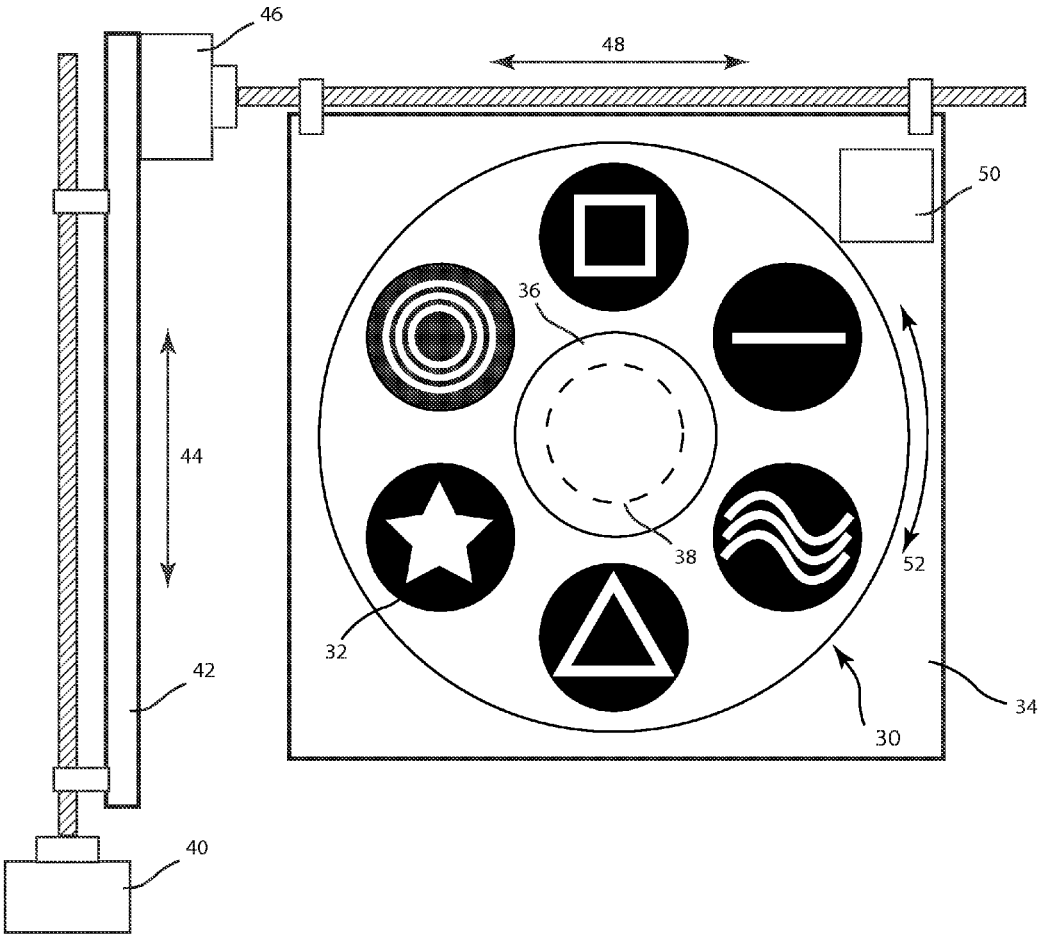
FIG. 8 illustrates a further embodiment of the animation wheel of FIG. 5.

FIG. 8 illustrates a schematic drawing of an embodiment of the invention. The mechanism as illustrated in FIG. 5 has been augmented with a third motor 50. Motor 50 is mounted to carrier plate 34 and moved with carrier plate 34. The rotation of the output shaft of motor 50 is coupled to gobo wheel 30 so as to allow rotation 52 of gobo wheel 30 around the axis of its central aperture 36. This rotation of gobo wheel 30 can be utilized in a number of ways. Firstly it could be used to simulate a prior art gobo wheel where rotation of the wheel positions all gobos in turn across optical aperture 38. Alternatively it can be used with a single large gobo as shown in FIGS. 6, 7*a* & 7*b* to move a single large image across the optical aperture to provide movement or effects such as rain or fire.

Figure 9:
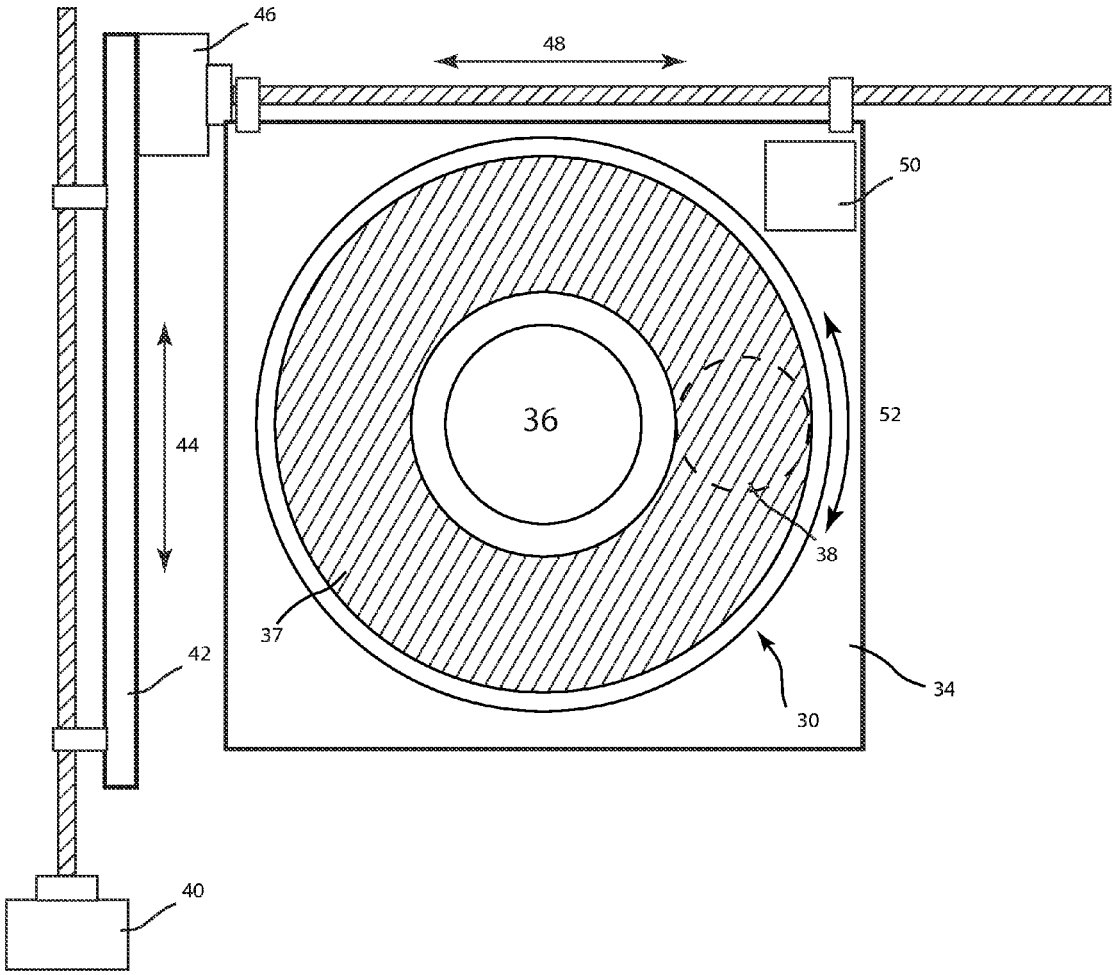
FIG. 9 illustrates a further embodiment of the animation wheel of FIG. 6 and FIG. 7 invention.

In a yet further embodiment as illustrated in FIG. 9, gobo wheel 30 may comprise a single piece of optical filter glass with, for example, lenticular lens pattern or prisms. Rotation of such a wheel by motor 50 will cause a rotation of the optical effect caused by the optical filter glass.

In alternative embodiments of systems such as that illustrated in FIG. 8, motor 50 drives the rotation of the gobos rather than the wheel 30. I this way the affects wheel can be positioned to place a gobo 32 in the path cross-section 38 and then the gobo 32 rotates causing the projected image to be rotated.

In alternative embodiments the gobo wheel need not be round and may not have a central aperture or any aperture.

Figure 10:
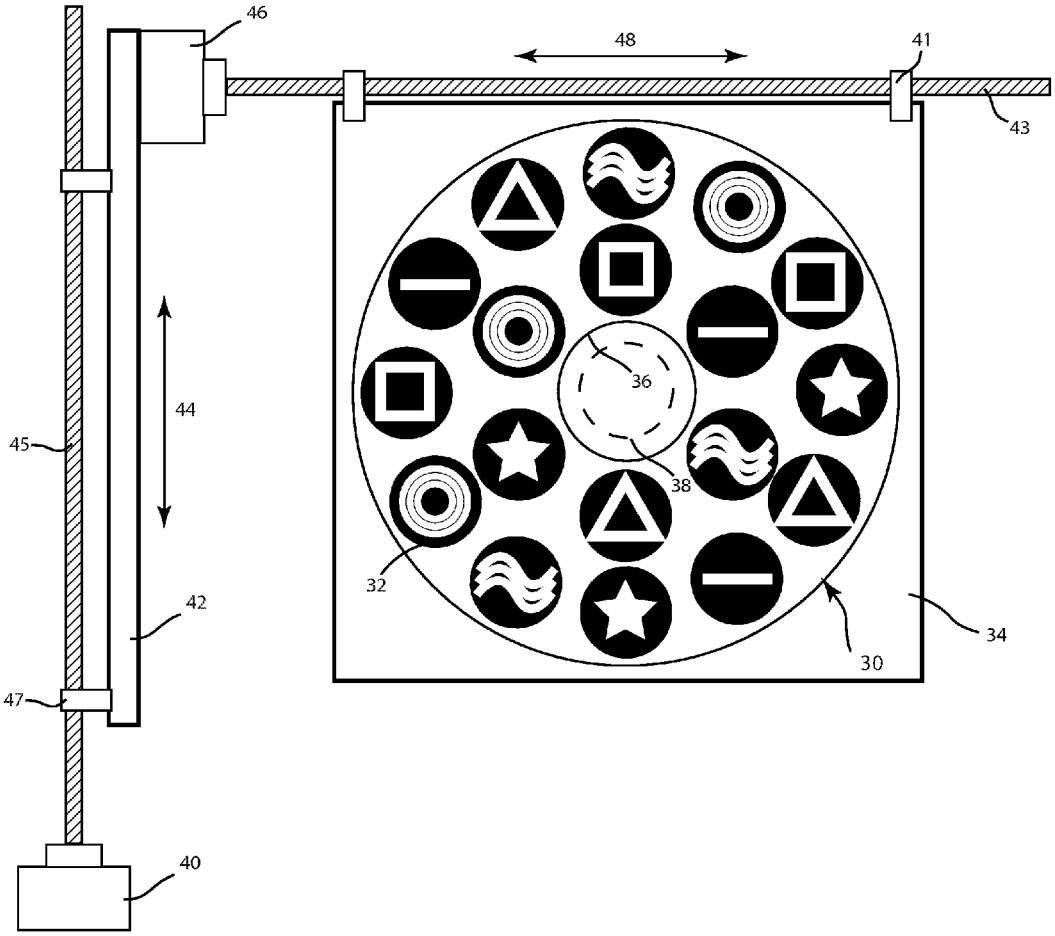
FIG. 10 illustrates a further embodiment of the animation wheel of FIG. 5 and/or FIG. 8.

FIG. 10 illustrates a further embodiment of the invention. The mechanism is similar to that shown and described in FIG. 5 however gobo wheel 30 contains two concentric rings of gobos 32. In this embodiment the frame 34 may be moved through rotation of motors 40 and 46 such that any individual gobo 32 is positioned across aperture 38. Although two rings of gobos are illustrated the invention is not so limited and any number of arrangement of gobos 32 may be positioned on gobo wheel 30 such that individual gobos 32 may be positioned across aperture 38. Such gobos 32 may be of differing sizes and orientations.

While the invention has been described with respect to a limited number of embodiments, those skilled in the art, having benefit of this invention, will appreciate that other embodiments may be devised which do not depart from the scope of the invention as disclosed herein. Accordingly, the scope of the invention should be limited only by the attached claims.

The invention has been described in detail, it should be understood that various changes, substitutions and alterations can be made hereto without departing from the spirit and scope of the invention as described by the appended claims.

What is claimed is:

1. An automated imaging luminaire comprising:

a light source creating a focusable light beam with a central axis for projecting images;

a animation plate mounted in the luminaire to intersect the light beam proximate to a focusable plane in the light beam;

a positioning drive to position the plate in the light beam with two degrees of positional freedom anywhere within a confined plane.

2. The automated imaging luminaire of claim 1 where the animation plate contains shaped glass that changes the cross sectional shape of the light beam.

3. The automated imaging luminaire of claim 1 where the animation plate contains a plurality of discrete projectioned gobo images generally sized to fill the cross section of the light beam.

4. The automated imaging luminaire of claim 2 or 3 where the gobo animation plate contains includes a positioning drive that drives a rotational third degree of freedom for the gobo animation plate.

5. The automated imaging luminaire of claim 2 or 3 where the gobo animation plate contains a missing section that allows the full light beam to bypass the gobo animation plate.

6. The luminaire of claim 1 where the confined plane is perpendicular to the central axis of the light beam.

7. An automated imaging luminaire comprising:

a light source creating a focusable light beam with a central axis for projecting images;

a animation plate contains shaped glass that changes the cross sectional shape of the light beam and is mounted in the luminaire to intersect the light beam proximate to a focusable plane in the light beam;

a mechanical drive to position the plate in the light beam with two degrees of positional freedom anywhere within a confined plane; and a mechanical drive that allows for a rotational third degree of freedom for the gobo animation plate.

8. The automated imaging luminaire of claim 7 where the animation plate contains a plurality of discrete projectioned gobo images generally sized to fill the cross section of the light beam.

9. The luminaire of claim 7 where the rotational third degree of freedom has a rotational axis parallel to the light beam's central axis.

10. An automated imaging luminaire comprising:

a light source creating a focusable light beam with a central axis for projecting images;

a animation plate contains shaped glass that changes the cross sectional shape of the light beam and is mounted in the luminaire to intersect the light beam proximate to a focusable plane in the light beam and contains a plurality of discrete projectionable gobo images;

a mechanical drive to drive the plate in the light beam with two degrees of positional freedom anywhere within a confined plane; and a mechanical drive that allows for a rotational third degree of freedom for the gobo animation plate.

* * * * *